US006452563B1

(12) United States Patent
Porte

(10) Patent No.: US 6,452,563 B1
(45) Date of Patent: Sep. 17, 2002

(54) ANTENNA ARRANGEMENT IN A METALLIC ENVIRONMENT

(75) Inventor: Philippe Porte, Aix-en-Provence (FR)

(73) Assignee: Gemplus, Gemnos (FR)

( * ) Notice: Subject to any disclaimer, the term of this patent is extended or adjusted under 35 U.S.C. 154(b) by 0 days.

(21) Appl. No.: 09/857,979

(22) PCT Filed: Dec. 21, 1999

(86) PCT No.: PCT/FR99/03223

§ 371 (c)(1),
(2), (4) Date: Jun. 11, 2001

(87) PCT Pub. No.: WO00/38275

PCT Pub. Date: Jun. 29, 2000

(30) Foreign Application Priority Data

Dec. 22, 1998 (FR) ..... 98 16517

(51) Int. Cl.[7] ..... H01Q 7/00
(52) U.S. Cl. ..... 343/866; 343/866; 343/742
(58) Field of Search ..... 343/866, 867, 343/741, 742, 767; H01Q 7/00

(56) References Cited

U.S. PATENT DOCUMENTS 5,039,996 A * 8/1991 Fockens ..... 343/866
6,329,928 B1 * 12/2001 Hershey ..... 340/870.07

OTHER PUBLICATIONS

Carr J. J. "Small Loop Antennas for MW AM BCB . . . " Elektor Electronics v 20 No. 223 Jun. 1, 1994, pp. 58–63.

Itakura, H. et al "Analytical Study of a Planar . . . " vol. 2 Jun. 18, 1995, pp. 1140–1143 I.E.E.E. Antennas & Prop 'Soc' Intl' Symp. Digest.

* cited by examiner

*Primary Examiner*—Hoanganh Le
(74) *Attorney, Agent, or Firm*—Roland Plottel

(57) ABSTRACT

The invention concerns an arrangement for an antenna (A) having the general shape of a loop, directly in the proximity of at least a metallic element (10). The invention is characterised in that each metallic element (10) comprises an orifice (18) arranged substantially opposite the surface defined by the antenna (A), and a slot (16) forming a gap width, arranged through the thickness of the metallic element (10), between the internal edge (21) delimiting the orifice (18) and the external edge (20) of said metallic element (10). The invention is applicable to scanners and radio frequency communication devices.

12 Claims, 3 Drawing Sheets

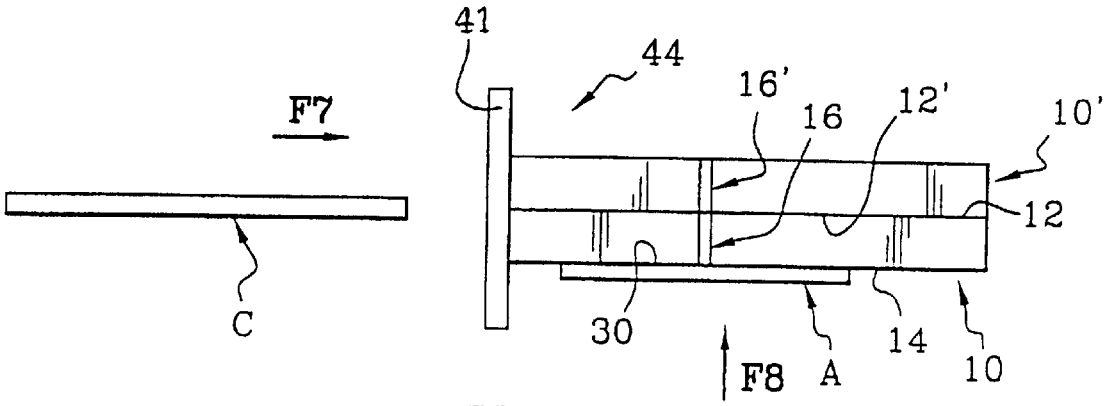
FIG.6
FIG.7
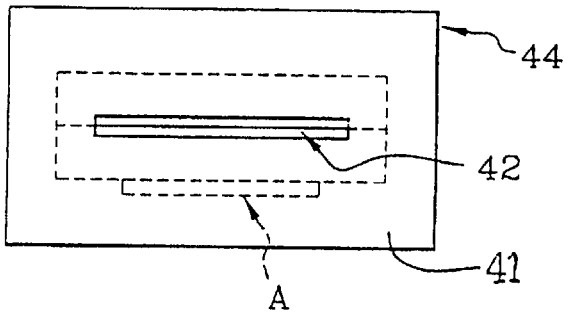
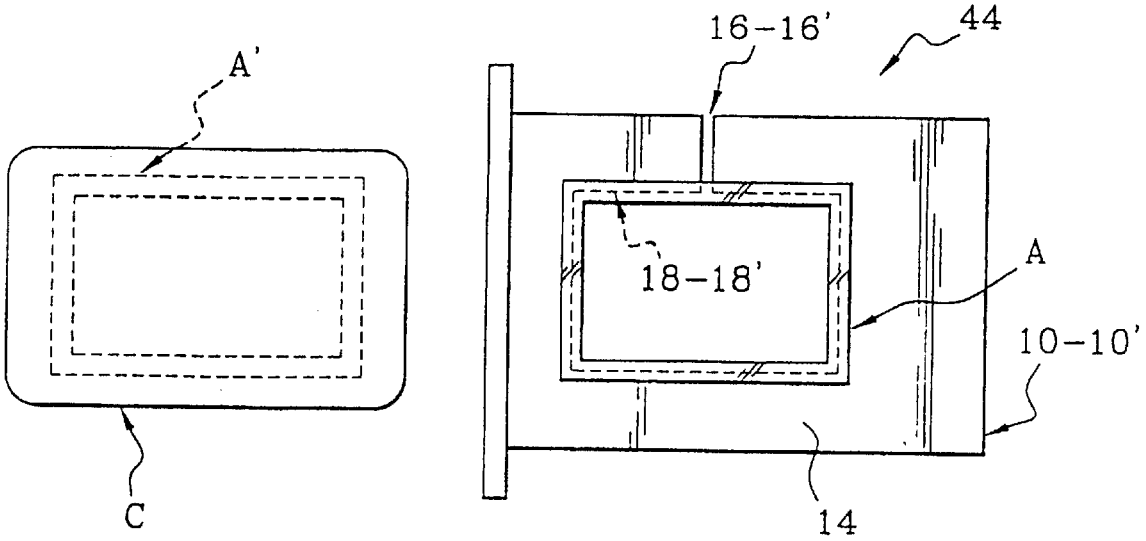
FIG.8

ANTENNA ARRANGEMENT IN A METALLIC ENVIRONMENT

The present invention relates to an arrangement of an antenna in a metallic environment.

The invention more particularly relates to the arrangement of an antenna in the general form of a loop, of the type comprising at least one turn; the said antenna extending directly in the vicinity of and substantially parallel to at least one metallic element.

It is known from the state of the art that the presence of metal in the immediate vicinity of an antenna in the form of a loop generates disturbances with regard to the transmission and/or reception of the electromagnetic waves. This is because the function of such an antenna is generally to transmit or pick up a field with a dominant magnetic component. If it is positioned in the direct vicinity of a metallic element, the latter will naturally have a tendency to behave like a turn in short circuit. The performance of the antenna will consequently be degraded, or even completely destroyed.

The use of antennae in the form of a loop is becoming widespread and finds many applications since they are found for example in the body of microprocessor cards of the contactless type, in the support element for so-called "intelligent" electronic labels, but particularly in many readers and other radiofrequency communication devices.

For many applications, such as for example access control or vending machines, it is important for the antennae and the associated electronics to be able to protected against vandalism and consequently to be integrated into a metallic environment.

In order to avoid the problems mentioned above, that is to say those resulting from the influence of the metallic environment on the functioning of the antenna, it has already been proposed to interpose a layer of "absorbent" material between the antenna and the supporting metallic element. However, it is generally a case of an expensive material such as ferrite, which substantially limits the advantage of this solution.

More generally, the antenna is intentionally kept distant from the metallic environment, the relative positions of these two elements being determined so as to obtain a satisfactory functioning of the antenna. This type of arrangement does however have the drawback of considerably increasing the total bulk of the whole.

Thus the technical problem to be resolved by the object of the present invention is to propose an arrangement of an antenna in the general form of a loop, directly in the vicinity of at least one metallic element, an arrangement which will make it possible to avoid the problems of the state of the art by offering minimum bulk, whilst still having a limited production cost.

The solution to the technical problem posed consists, according to the present invention, of each metallic element having on the one hand an aperture provided substantially opposite the surface delimited by the antenna and on the other hand a slot forming an air gap, formed through the thickness of the metallic element, between the internal edge delimiting the aperture and the external edge of the said metallic element.

The combination of the aperture and the air gap formed on each metallic element makes it possible to avoid any phenomenon of shielding of the antenna by the said metallic element. The invention as thus defined has the advantage of guaranteeing perfect functioning of the antenna in a metallic environment, even in the absence of any interposed absorbent material or any significant separation between the said antenna and the metallic element in question. Thus the antenna therefore offers identical or equivalent performances to those which it would have in a non-metallic environment, whilst benefiting from the advantages peculiar to the use of metal, notably in terms of security and more particularly resistance to vandalism.

In a particularly advantageous fashion, the antenna lies substantially parallel to the metallic element of which it is directly in the vicinity, in order to limit the bulk of the whole to the maximum possible extent. The antenna and the contiguous metallic element are thus positioned side by side with a small intervening space, which may even be zero.

According to one particularity of the invention, the surface delimited by the internal edge of the aperture is substantially equal to the surface of the antenna. The characteristics of the aperture with regard to shape and dimensions have in fact a direct impact on the performance of the antenna, since the passage of the electromagnetic waves takes place precisely through the said aperture, independently of the essential presence of the air gap.

According to another particularity of the invention, the internal edge of the aperture is shaped so as to be substantially parallel to the contour of the antenna. In other words, the shape of the aperture corresponds substantially to the projection of the contour of the antenna onto the metallic element. An optimised functioning is in fact obtained when the respective surfaces of the aperture and of the antenna are equivalent.

In a particularly advantageous fashion, the internal edge of the aperture coincides with the mid-axis of the loop forming the antenna. The shape of the aperture corresponds here to the projection of the mid-axis of the antenna onto the metallic element. It should be noted that the mid-axis designates the median line passing longitudinally through the loop, and this whatever the number of turns making up the antenna.

This conformation constitutes an optimum solution in that, on each side of the mid-axis, that is to say in the case where the shape of the aperture is larger or smaller than this limit, the performance of the antenna is significantly reduced.

According to one variant of the invention, the antenna extends between two metallic elements, with respect to each of which the said antenna is positioned directly in proximity. Naturally, each metallic element is in accordance with the invention, that is to say it has an aperture and an air gap as defined previously.

This configuration, in which two metallic elements are positioned on each side of the antenna, corresponds for example to the integration of an antenna inside any metallic part, such as a watch case for example.

According to another variant of the invention, the antenna lies outside an assembly including two metallic elements between which a space is formed, able to receive a removable device also provided with an antenna in the form of a loop; the external antenna being positioned directly in the vicinity of the external face of one of the metallic elements. This configuration can concern, for example, an insertion reader, or a contactless card or electronic labels.

According to another characteristic of the invention, the different metallic elements being fixed together, the respective apertures and slots are associated so as to constitute a single air gap. The important thing is that the air gap peculiar to each metallic element is not short-circuited by any portion of the adjacent metallic element. This results in positioning the slots substantially facing each other, and this whatever their respective dimensions. Thus it can therefore be considered that the joined-together metallic elements have only one air gap.

Advantageously, the metallic elements intended to be positioned close to the antenna may be symmetrical. This means that their identical shapes can be positioned easily opposite each other, symmetrically with respect to the antenna, so as to be able to have very simply a single air gap. The apertures of the different metallic elements, just like the slots also, are then positioned precisely opposite each other.

According to another particularity of the invention, the different metallic elements belong to the same piece. This configuration is of course equivalent to that for which the different parts, coming to be positioned close to the antenna, are joined together.

Other characteristics and advantages of the invention will emerge from a reading of the following description with reference to the accompanying drawings, given by way of non-limitative examples. This detailed description will give an understanding of what the invention consists and how it can be implemented.

FIG. 6 is a side elevation view illustrating another application of an arrangement according to the teachings of the invention. It depicts a card provided with an antenna, in the approach position with a view to its insertion in a reading device with a metallic environment also having a loop antenna.

FIG. 7 is a side end view of the reading device, in the direction of the arrow F7 in FIG. 6.

FIG. 8 is a view from below, in the direction of the arrow F8 in FIG. 6, of the assembly illustrated in FIG. 6.

For reasons of clarity, the same elements have been designated by identical references. Likewise, only the elements essential for an understanding of the invention have been shown, without regard for scale and schematically.

Figure 1:
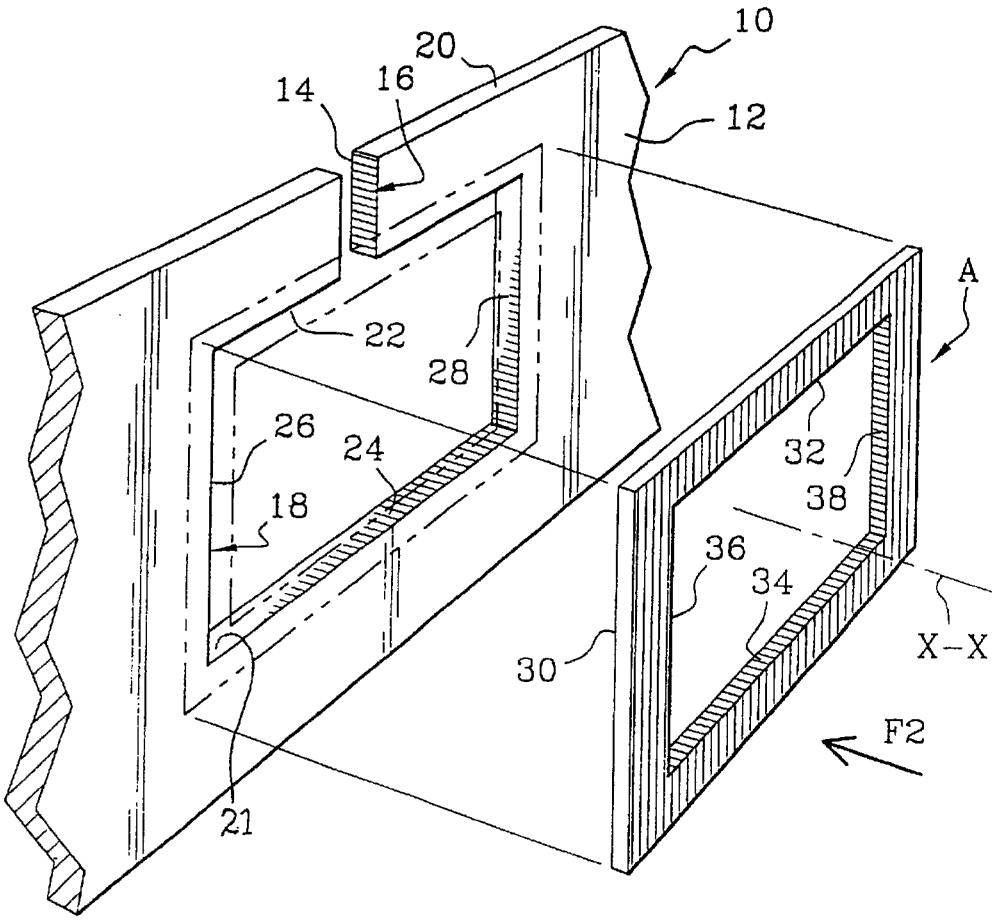
FIG. 1 is a schematic view in exploded perspective, which illustrates a first example of an arrangement of a loop antenna in accordance with the teachings of the invention.
Figure 2:
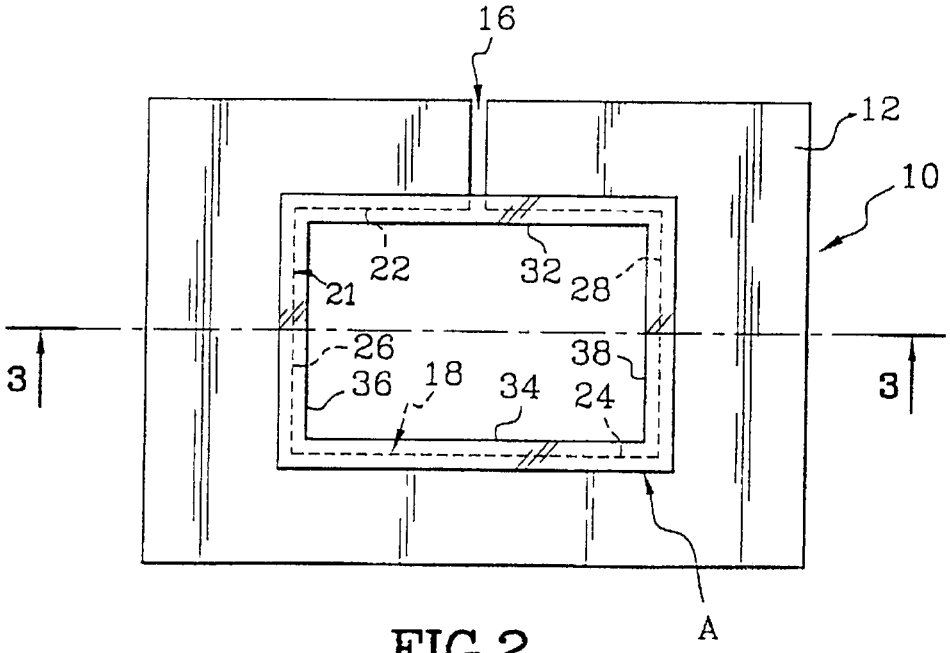
FIG. 2 is an end view, in the direction of the arrow F2 in FIG. 1, which illustrates the loop antenna in position on its metallic support piece.
Figure 3:
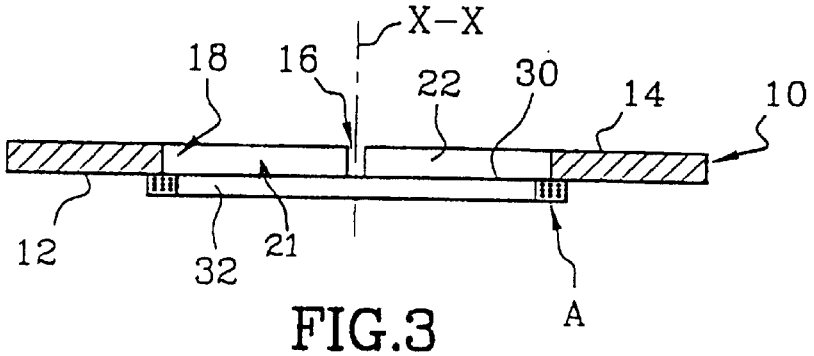
FIG. 3 is a schematic view in section along the line 3—3 in FIG. 2.

The particular embodiment illustrated in FIGS. 1 to 3 concerns the integration of a loop antenna A behind a metallic plate 10. Although basic, this configuration is very important because it is able to be applied very widely. This includes here notably arrangements of an antenna behind a metallic front face, for example of a dispenser of the vending machine type or an access control appliance of the Metro ticket barrier type.

In this example embodiment, the metallic element therefore consists of a metallic plate 10 delimited by two opposite flat faces 12 and 14. In accordance with the teachings of the invention, the metallic plate 10 has an aperture 18 and a slot 16 forming an air gap.

More precisely, the slot 16 is formed through the thickness of the metallic plate 10, between the internal edge 21 delimiting the aperture 18 and the external edge 20 of the said metallic plate 10. In other words, it is an opening-out slot which extends on the one hand axially along the axis X—X of the antenna A, the axis being substantially perpendicular to the mid-plane of the loop of the said antenna A. The slot 16 thus opens out at each of the opposite faces 12, 14 of the metallic plate 10. In addition, the slot 16 also extends transversely with respect to the same axis X—X, from an external lateral edge 20 of the plate 10, here vertically downwards as seen in FIGS. 1 and 3, in order to open out radially towards the inside, at the internal edge 21 of the aperture 18.

From the electromagnetic point of view, the slot 16 constitutes an air gap which makes it possible to "open up" the metallic environment in the vicinity of which the loop antenna A is positioned; the portion of the plate 10 disposed opposite the surface of the said antenna A being of course cleared of any metal.

In this first example chosen to illustrate the invention, the loop antenna A is rectangular in shape. Independently of its shape, which can be variable, it should be noted that the loop antenna A can be of any design, that is to say notably consisting of a winding in loop form of one or more turns.

The metallic plate 10 serves here directly as a support for the loop antenna A. The latter is fixed, for example by adhesive bonding, to the face 12 whilst the opposite face 14 remains free. In this extreme configuration, the antenna A is truly positioned directly close to the metallic element, since it extends perfectly parallel to the internal face 12 of the plate 10. The portion of this face 12, along which the loop antenna A extends, is here perfectly flat.

As can be seen in FIGS. 1 to 3, the internal edge 21 delimiting the aperture 18 has a rectangular contour which corresponds substantially to the rectangular contour of the antenna A. As a result the surface delimited by the internal edge 21 of the aperture 18 is substantially equal to the surface of the antenna A.

More precisely, the dimensions and the relative positioning of the antenna A and aperture 18 are such that the internal edge 21 of the aperture 18 is parallel to the rectangular profile of the loop antenna A. In other words, each linear portion 22, 24, 26, 28 of the internal edge 21 is individually parallel to each linear portion 32, 34, 36, 38 forming the contour of the antenna A.

In order to optimise the performance of the loop antenna A, the internal edge is sized so as to coincide with the mid-axis of the antenna A, that is to say with the mid-axis of its turn when it has only one turn, or with the mid-axis of the group of turns constituting the loop antenna A in the contrary case.

It is when the antenna A is fixed to the metallic plate 10 forming a support, for example by gluing its face 30 to the corresponding parts of the face 12 of the plate 10, that the precise optimum positioning of the loop antenna A with respect to the aperture 18 is ensured.

The arrangement which has just been described, with reference to FIGS. 1 to 3, thus enables a loop antenna A to be integrated in a metallic environment whatever the conformation of the support 10, this not necessarily being a plate but being able to be any piece, notably with a greater thickness. This integration is of course independent of the external shape of the said metallic piece.

The metallic piece is not necessarily a single piece with a continuous structure. It can also consist of an assembly of different metallic elements. In the same way, the invention is also not limited to the case where the loop of the antenna has a rectangular contour.

The integration according to the invention is advantageously obtained without adding any material or component, and therefore very economically. It also enables the antenna A to be pressed against the piece 10, that is to say it does not make it necessary to unnecessarily increase the bulk of the whole.

Figure 4:
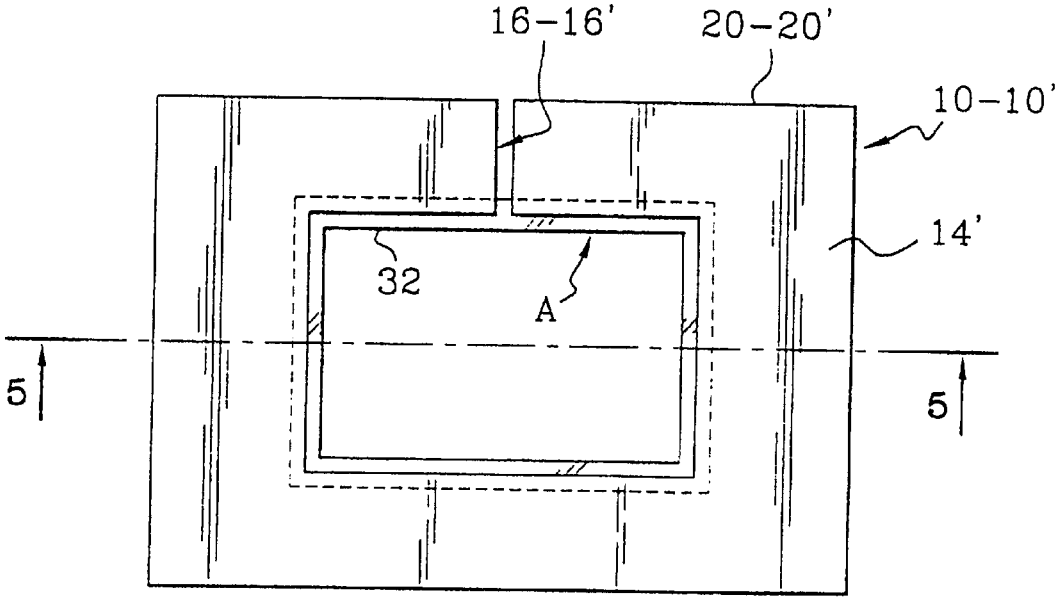
FIGS. 4 and 5 are views similar to those in FIGS. 2 and 3, illustrating a second example of an arrangement according to the invention, in which the antenna is integrated between two adjacent metallic elements.
Figure 5:
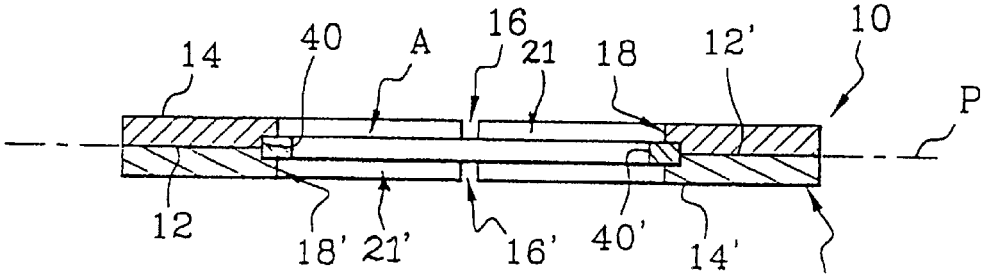

As can be seen in FIGS. 4 and 5, the second example embodiment chosen to illustrate the invention concerns the integration of a loop antenna actually inside a metallic environment.

For obvious reasons of simplicity and therefore clarity, the antenna is here of the same type as described previously. Likewise, the metallic environment is simply composed of two adjacent metallic plates 10 and 10', also substantially similar to the plate 10 described with reference to FIGS. 1 to 3. The design of the arrangement illustrated in FIGS. 4 and 5 also has symmetry with respect to a plane P which corresponds to the mid-plane of the loop antenna A (FIG. 5).

Thus each metallic element 10, 10' therefore has an opening-out slot 16, 16' forming an air gap, which extends axially in a direction substantially perpendicular to the mid-plane P of the loop of the antenna A, throughout the thickness of the said element 10, 10'. This slot 16, 16' also extends transversely from an external lateral edge 20, 20' of the metallic element 10, 10' as far as the internal edge 21, 21' of a central aperture 18, 18' formed axially through the said metallic element 10, 10', substantially opposite the internal area of the antenna which is delimited by the loop.

As indicated previously, each metallic plate 10, 10' is therefore formed in a substantially similar manner to its homologue in the first example embodiment. It differs from this in fact essentially only through the presence of a housing 40, 40' with a complementary shape to the part of the loop antenna A with which it is intended to come into contact, or at the very least close to. The assembly is formed so that the antenna A is perfectly integrated between the metallic plates 10, 10' when the respective internal faces 12, 12' of the said plates are in contact with each other. This means that the antenna A is here advantageously interposed without any clearance, whatever the direction in question. This characteristic also makes it possible to precisely position the antenna A in its metallic environment, since the said antenna A is trapped between the two metallic plates 10 and 10' in the housing 40—40'.

The symmetry of design is such that the slots 16 and 16' are aligned one opposite the other so as to constitute a single air gap forming an "opening or interruption" in the metallic environment.

The third example chosen to illustrate the invention for its part relates to a particular embodiment using two antenna in the general form of a loop. The first antenna is equivalent to those described above, in that it is fixed to the metallic environment. It is in fact positioned directly in the vicinity of the external face of a metallic element. The second antenna is on the other hand connected to an independent and removable device, able to fit inside the metallic environment, in a similar manner to the second embodiment, except that this arrangement is not fixed. In this, this third embodiment can be considered to be a combination of the first two.

One example of this type of configuration is illustrated in FIGS. 6 to 8, in the form of an insertion reader for contactless cards. Thus a reading device 44 has therefore been shown, having a slot 42 through which a card C integrating a loop antenna A' can be inserted and/or withdrawn. Obviously, the reading device 44 is provided with a reception and/or transmission antenna A intended to exchange data with the antenna A' of the card C.

The main body of the reading device 44 consists of two adjacent metallic plates 10 and 10' each having a slot 16, 16' forming an air gap and a central aperture 18, 18'. The whole is formed and disposed in a substantially similar manner to their homologues in FIGS. 4 and 5.

The same does not apply with regard to the associated antenna A, since the positioning of the latter with respect to the metallic environment corresponds rather to the arrangement illustrated in FIGS. 1 to 3. In this precise case, the antenna A extends in fact close to the external face 14 of the plate 10 and is consequently not directly in contact with the other plate 10'. Finally, this corresponds to the arrangement of a loop antenna in a metallic environment consisting here of the superimposition of two identical and symmetrical metallic plates 10, 10'.

The space formed between the two metallic plates 10, 10', which in the second embodiment was intended to receive the loop antenna permanently, is here shaped so as to be able to accept the card C occasionally, after its insertion through the slot 42 formed in the front panel 41. Thus, when the card C is in the data exchange position in the reading device 44, its precise positioning with respect to the openings 18 and 18' is therefore such that the arrangement of the antenna A' with respect to the plates 10, 10' is then similar to the one illustrated in FIGS. 4 and 5, that is to say the case of an antenna A' arranged actually inside a metallic environment is found once again.

Here too, in order to optimise both the performance of the antenna A and that of the antenna A', it is desirable for the contour of the aligned apertures 18 and 18' to coincide with the mid-axis of the antennae A and A'.

In the case where the geometry and/or dimensions of the two antennae A and A' are slightly different, a compromise is determined between the best possible coupling of the two antennae and the respective individual performances of these with respect to the metallic environment.

What is claimed is:

1. An arrangement comprising an external antenna (A) in the general form of a loop, at least one metallic element (10, 10') located in the vicinity of said antenna and having an aperture (18, 18') substantially opposite a surface delimited by the antenna and a slot (16, 16') forming an air gap through a thickness of the metallic element between an internal edge (21, 21') delimiting the aperture and an external edge (20, 20') of said metallic element, said metallic element having a space able to received a removable device (C) provided with an internal antenna (A') in the form of a loop, the external antenna being positioned directly in the vicinity of an external face (14, 14') of the metallic element.

2. The arrangement according to claim 1, wherein the antenna (A) extends substantially parallel to the metallic element (10, 10') of which it is directly in the vicinity.

3. The arrangement according to claim 1, wherein the surface delimited by the internal edge (21, 21') of the aperture (18, 18') is substantially equal to the surface of the antenna A.

4. The arrangement according to claim 1, characterised in that the internal edge(21, 21') of the aperture(18, 18') is substantially parallel to the contour of the antenna A.

5. The arrangement according to claim 1, characterised in that the internal edge 21, 21' of the aperture (18, 18') coincides with a mid-axis P of the loop forming the external antenna (A).

6. The arrangement according to claim 1, wherein said metallic element comprises two metallic elements (10, 10') between which there is formed said space able to receive said removable device (C) provided with said internal antenna (A).

7. The arrangement according to claim 6, wherein the two metallic elements (10, 10') being joined together, and having respective apertures (18, 18') and slots (16, 16') that are associated so as to form a single air gap.

8. The arrangement according to claim 7, wherein the apertures (18, 18') of the two metallic elements (10, 10') are opposite each other.

9. The arrangement according to claim 7, characterised in that the slots (16, 16') of the two metallic elements (10, 10') are opposite each other.

10. The arrangement according to claim 7, characterised in that the two metallic elements (10, 10') have substantially identical shapes.

11. The arrangement according to claim 1, characterised in that the portion of the metallic element (10, 10') close to which the antenna (A) extends is flat.

12. The arrangement according to claim 6, wherein at least one of the metallic elements (10, 10') is a metallic plate.

* * * * *